US010366871B2

(12) United States Patent
Murthy

(10) Patent No.: US 10,366,871 B2
(45) Date of Patent: Jul. 30, 2019

(54) ANALYZER

(71) Applicant: ATONARP INC., Minato-ku, Tokyo (JP)

(72) Inventor: Prakash Sreedhar Murthy, Tsukuba (JP)

(73) Assignee: ATONARP INC., Minato-ku, Tokyo (JP)

( * ) Notice: Subject to any disclaimer, the term of this patent is extended or adjusted under 35 U.S.C. 154(b) by 0 days.

(21) Appl. No.: 15/915,710

(22) Filed: Mar. 8, 2018

(65) Prior Publication Data

US 2018/0197725 A1 Jul. 12, 2018

Related U.S. Application Data

(63) Continuation of application No. 15/451,856, filed on Mar. 7, 2017, now abandoned, which is a (Continued)

(30) Foreign Application Priority Data

Aug. 30, 2013 (JP) ..... 2013-180483

(51) Int. Cl.
*H01J 49/00* (2006.01)
*H01J 49/20* (2006.01)
(Continued)

(52) U.S. Cl.
CPC ..... *H01J 49/0031* (2013.01); *H01J 49/025* (2013.01); *H01J 49/06* (2013.01);
(Continued)

(58) Field of Classification Search
CPC ..... H01J 49/025; H01J 49/26; H01J 49/0031; H01J 49/0036; H01J 49/42; H01J 49/421; H01J 49/463
See application file for complete search history.

(56) References Cited

U.S. PATENT DOCUMENTS 3,566,674 A * 3/1971 Talroze ..... G01N 30/7206 250/432 R
3,946,229 A * 3/1976 Moseman, Jr. ..... H01J 49/0009 250/292
(Continued)

FOREIGN PATENT DOCUMENTS

JP 53-33689 A 3/1978
JP 60-152949 8/1985
(Continued)

OTHER PUBLICATIONS

International Search Report (PCT/ISA/210) dated Nov. 4, 2014, by the Japanese Patent Office as the International Searching Authority for International Application No. PCT/JP2014/004450.
(Continued)

*Primary Examiner* — Wyatt A Stoffa
(74) *Attorney, Agent, or Firm* — Buchanan Ingersoll & Rooney PC

(57) ABSTRACT

An analyzer includes: an ionizer unit that ionizes molecules to be analyzed; a filter unit that selectively passes ions generated by the ionizer unit; and a detection unit that detects ions that have passed the filter unit. The detection unit includes a plurality of detection elements disposed in a matrix, and the analyzer further includes a first reconfiguration unit that switches between detection patterns including detection elements to be enabled for detection out of the plurality of detection elements. The ionizer unit includes a plurality of ion sources, and the analyzer further includes a driving control unit that switches the connections of the plurality of ion sources based on changes in characteristics of the ion sources.

8 Claims, 5 Drawing Sheets

Related U.S. Application Data continuation of application No. 14/891,123, filed as application No. PCT/JP2014/004450 on Aug. 29, 2014, now Pat. No. 9,666,422.

(51) Int. Cl.

| | |
|---|---|
| ***H01J 49/42*** | (2006.01) |
| ***H01J 49/26*** | (2006.01) |
| ***H01J 49/02*** | (2006.01) |
| ***H01J 49/10*** | (2006.01) |
| ***H01J 49/14*** | (2006.01) |
| ***H01J 49/06*** | (2006.01) |

(52) U.S. Cl.

CPC ..... *H01J 49/107* (2013.01); *H01J 49/147* (2013.01); *H01J 49/20* (2013.01); *H01J 49/26* (2013.01); *H01J 49/421* (2013.01)

(56) References Cited

U.S. PATENT DOCUMENTS

| | | | | |
|---|---|---|---|---|
| 4,016,421 | A * | 4/1977 | Hull | H01J 49/0422 250/281 |
| 4,973,841 | A * | 11/1990 | Purser | B01D 59/48 250/281 |
| 6,480,278 | B1 | 11/2002 | Fuerstenau et al. | |
| 6,646,257 | B1 | 11/2003 | Fischer et al. | |
| 7,498,585 | B2 | 3/2009 | Denton et al. | |
| 8,389,929 | B2 | 3/2013 | Schoen et al. | |
| 8,598,522 | B2 * | 12/2013 | Tomany | H01J 49/168 250/288 |
| 8,648,293 | B2 * | 2/2014 | Correale | G01N 1/2202 250/252.1 |
| 8,704,162 | B1 * | 4/2014 | Shiohama | H01J 49/0009 250/281 |
| 9,040,907 | B2 * | 5/2015 | Brucker | H01J 49/147 250/281 |
| 2004/0031918 | A1 * | 2/2004 | Schoen | H01J 49/0009 250/282 |
| 2005/0080571 | A1 * | 4/2005 | Klee | H01J 49/0031 702/32 |
| 2005/0080578 | A1 * | 4/2005 | Klee | H01J 49/0009 702/85 |
| 2006/0219891 | A1 | 10/2006 | Balogh | |
| 2008/0067435 | A1 * | 3/2008 | Huang | H01J 37/026 250/492.21 |
| 2009/0108191 | A1 * | 4/2009 | Yefchak | H01J 49/025 250/252.1 |
| 2009/0194681 | A1 | 8/2009 | McCauley | |
| 2010/0076712 | A1 | 3/2010 | Aoki et al. | |
| 2010/0193684 | A1 * | 8/2010 | Mukaibatake | H01J 49/022 250/292 |
| 2011/0036976 | A1 * | 2/2011 | Mukaibatake | H01J 49/145 250/282 |
| 2012/0326027 | A1 * | 12/2012 | Sugiyama | H01J 49/0009 250/283 |
| 2013/0334415 | A1 | 12/2013 | Sugawara et al. | |
| 2014/0001354 | A1 * | 1/2014 | Asano | H01J 49/02 250/288 |
| 2015/0041635 | A1 * | 2/2015 | Green | H01J 49/0036 250/282 |
| 2015/0064739 | A1 * | 3/2015 | Nogami | G01N 1/4055 435/29 |
| 2016/0172170 | A1 | 6/2016 | Murthy | |
| 2017/0146544 | A1 * | 5/2017 | Schulz-Knappe | G01N 33/6848 |
| 2017/0370890 | A1 * | 12/2017 | Wapelhorst | G01N 33/0011 |

FOREIGN PATENT DOCUMENTS

| | | | |
|---|---|---|---|
| JP | 62-90980 | A | 4/1987 |
| JP | 05-135734 | | 6/1993 |
| JP | 2002-071821 | A | 3/2002 |
| JP | 2005-528746 | A | 9/2005 |
| JP | 2006-221876 | A | 8/2006 |
| JP | 2010-177120 | A | 8/2010 |
| JP | 2011-082181 | A | 4/2011 |
| JP | 2011-216425 | A | 10/2011 |
| JP | 2011-257333 | | 12/2011 |
| WO | WO 2007/083403 | A1 | 7/2007 |
| WO | WO 2008/129929 | A1 | 10/2008 |
| WO | WO 2012/105087 | A1 | 8/2012 |

OTHER PUBLICATIONS

Written Opinion (PCT/ISA/237) dated Nov. 4, 2014, by the Japanese Patent Office as the International Searching Authority for International Application No. PCT/JP2014/004450.

International Preliminary Examining Report (PCT/IPEA/210) dated Jul. 22, 2015, by the Japanese Patent Office as the International Preliminary Examining Authority for International Application No. PCT/JP2014/004450.

Notification of Transmittal of Translation of the International Preliminary Report on Patentability (Forms PCT/IB/338 and PCT/IPEA/409) dated Mar. 3, 2016, by the International Bureau of WIPO in corresponding International Patent Application No. PCT/JP2014/004450. (5 pages).

Notification of Reasons for Refusal issued in corresponding Japanese Patent Application No. 2016-239272, dated Jul. 10, 2018 (18 pages).

* cited by examiner

ANALYZER

CROSS-REFERENCE TO RELATED APPLICATIONS

The present application is a continuation of U.S. application Ser. No. 15/451,856, filed on Mar. 7, 2017, which is a continuation of U.S. application Ser. No. 14/891,123, filed on Nov. 13, 2015, now U.S. Pat. No. 9,666,422, which is a national stage application of PCT/JP2014/004450, filed on Aug. 29, 2014, and which claims the priority of JP 2013-180483 and JP 2013-180493, both of which were filed on Aug. 30, 2013. The contents of U.S. application Ser. No. 15/451,856; U.S. application Ser. No. 14/891,123; PCT/JP2014/004450; JP 2013-180483; and JP 2013-180493 are all incorporated herein by reference in their entirety.

TECHNICAL FIELD

The present disclosure relates to an analyzer that ionizes and analyzes a sample.

BACKGROUND ART

International Publication WO2008/129929 discloses a gas analyzer that uses quadrupole mass spectrometry or the like and includes: an ionizer unit that ionizes a sample gas; a first ion detection unit and a second ion detection unit that detect ions from the ionizer unit and are provided on both sides of the ionizer unit so as to be located at different distances from the ionizer unit; a filter unit that is provided between the ionizer unit and the first ion detection unit and selectively passes ions from the ionizer unit; and a calculator apparatus that uses a first total pressure of the sample gas obtained by the first ion detection unit and a second total pressure of the sample gas obtained by the second ion detection unit to correct a partial pressure of a specified component that is obtained by the first ion detection unit and selected by the filter pole unit, wherein it is possible, while maintaining the resolution, to carry out correction even in a region where the measured pressures do not track changes in the ambient pressure.

International Patent Publication WO2007/083403 discloses a quadrupole mass spectrometer in which a table for associating an appropriate DC bias voltage to each of a plurality of selectable scan speeds is stored in advance in an auto-tuning data storage unit. In an auto-tuning operation, a controller determines the DC bias voltage corresponding to each scan speed by referring to the table and fixes the output of an ion-attracting voltage generator unit at that voltage. While changing the other applied voltages such as the voltage applied to an ion optical system, the controller finds voltage conditions under which the detection signal is maximized. The optimal conditions for each scan speed are then found and recorded in auto-tuning result data. During analysis of a target sample, a DC bias voltage corresponding to a scan speed specified by the operator is obtained from the table, optimal conditions are obtained from the auto-tuning result data, and the scan measurement conditions are determined based on such information. By doing so, it is possible to prevent deterioration in the detection sensitivity when the scan measurement is performed at a high scan speed.

SUMMARY

During automatic adjustment of a mass spectrometer (mass analyzer), voltage conditions are found so as to maximize the detection signal. This is to prevent saturation of a detection signal for high-concentration components. Accordingly, the detection signal of the low-concentration components is small and susceptible to a drop in precision.

One aspect of the present disclosure is an analyzer including: an ionizer unit that ionizes molecules to be analyzed; a filter unit that selectively passes ions generated by the ionizer unit; and a detection unit that detects ions that have passed the filter unit. The detection unit includes a plurality of detection elements disposed in a matrix. The analyzer further includes a first reconfiguration unit that switches between detection patterns including detection elements to be enabled for detection out of the plurality of detection elements. A typical detection unit is a detection unit that measures an ion current and a typical detection element is a Faraday cup. The detection elements may be secondary electron multiplier type elements or CCD type elements. The plurality of detection elements may be laid out in two dimensions or may be laid out in three dimensions.

By reconfiguring a detection pattern composed of a plurality of detection elements, it is possible to change the sensitivity of the detection units according to the amount of ions and to select a pattern suited to the path and conditions via that the type of ions reach the detection unit. Accordingly, it is possible to provide an analyzer apparatus capable of precisely measuring components with a high concentration and also capable of precisely measuring components with a low concentration.

The ionizer unit may include a plurality of ion sources, and the analyzer apparatus may include: a monitor that estimates or measures changes in characteristics of the respective ion sources out of the plurality of ion sources; and a second reconfiguration unit that reconfigures the ionizer unit. Based on changes in characteristics of the plurality of ion sources obtained by the monitor, the second reconfiguration unit reconfigures, among or out of the plurality of ion sources, at least one of a selection of ion sources to be activated, connections of the plurality of ion sources to be activated, and supplying of power to the ion sources to be activated.

It is desirable for the ionizer unit to have a stabilized output voltage and current. However, changes in characteristics due to aging variation, life span, and the like are unavoidable. Even if the characteristics have changed due to changes over time and the life span of the ion sources, by using the second reconfiguration unit to change the ion sources to be activated or connecting a plurality of ion sources in parallel or in series and in parallel, it is possible to carry out control to suppress the changes in the characteristics of the ionizer unit to within a certain range over a long period. Using the second reconfiguration unit, it is possible to rotate the use of, and/or change the connections between, a plurality of ion sources (in particular three or more ion sources) so that the power supplied to the activated ion sources is within a range where a long life span can be expected.

The respective ion sources in the plurality of ion sources may include an emitter that emits electrons and a grid provides a potential difference with respect to the emitter. The emitter may include a filament and/or a disk cathode. The second reconfiguration unit may include a unit that independently reconfigures connections of the emitters and the grids. Normally, as one example, a filament and a grid are used as a pair to apply a bias voltage. By making it possible to connect the grids individually to the filaments, it is possible to use the grids as electrodes for adjusting the magnetic fields inside the ionizer unit, which makes it possible to improve the distribution of electrons in the ionizer unit and the circulation of the ionized molecules. The grids can also function as shields to prevent impurities from adhering to emitters in a non-activated state, which makes it possible to suppress deterioration of emitters such as filaments.

The monitor may monitor the power supplied to the ion sources, the temperature of the ion sources, and the like, and may include a unit that acquires the detection intensity of a tuning gas at the detection unit. Variations in the characteristics of ion sources can be determined from changes in the detection intensity of a component whose concentration has been confirmed.

The first reconfiguration unit may include a unit that selects or switches to a detection pattern at timing when the second reconfiguration unit controls the ionizer unit. When the ion current has changed due to reconfiguration of the ionizer unit, by selecting or switching the detection pattern of the detection unit, it is possible to absorb the changes in measurement conditions and carry out measurement with even higher precision. For example, when the ion current varies, by selecting a pattern with a small detection area when the ion current is large or increased and selecting a pattern with a large detection area when the ion current is small or decreased, it is possible to prevent situations where the measurement results become saturated or the measurement results become buried in noise.

The first reconfiguration unit may include a unit that selects or switches to a detection pattern in accordance with conditions by which the filter unit selects ions. When carrying out analysis where the concentration of each component (molecules, chemical substances, compounds) can be predicted to an extent, high-precision measurement is possible by using a detection pattern suited to measuring the predicted concentration. Although one example of the filter unit is a quadrupole filter, it is also possible to use a magnetic sector type, a double-focusing type, and other ion-transmitting filter such as a time-of-flight type. The filter may be a Wien filter, a non-vacuum filter such as a FAIMS, or any combination of the above.

Another aspect of the present disclosure is a control method for an analyzer, including the following step.

the second reconfiguration unit setting the ionizer unit so that ions with a standard concentration in a tuning gas are detected by a detection pattern with a medium-sized area set by the first reconfiguration unit.

By setting the detection unit at a middle range, it is possible to use detection patterns with different areas for components with a high concentration and components with a low concentration, and possible to extend the range of concentrations that can be measured with high precision.

The control method may include the following step.

the first reconfiguration unit switching, when the second reconfiguration unit has reconfigured the ionizer unit, between detection patterns so as to compensate an ion intensity due to reconfiguration of the ionizer unit. It is possible to compensate for the variations in the ionization performance with the reconfiguration of the ionizer unit, by switching between detection patterns on the detection unit side.

The control method may also include the following step.

detecting ions with selecting or switching to a detection pattern by the first reconfiguration unit in accordance with conditions of the filter unit for selecting ions. It is possible to use detection patterns with different areas for high-concentration components and low-concentration components, and possible to extend the range of concentrations that can be measured with high precision.

Yet another aspect of the present disclosure is a program (program product) including the above steps, which can be provided having been recorded on a suitable recording medium.

DETAIL DESCRIPTION OF PREFERRED EMBODIMENTS

Figure 1:
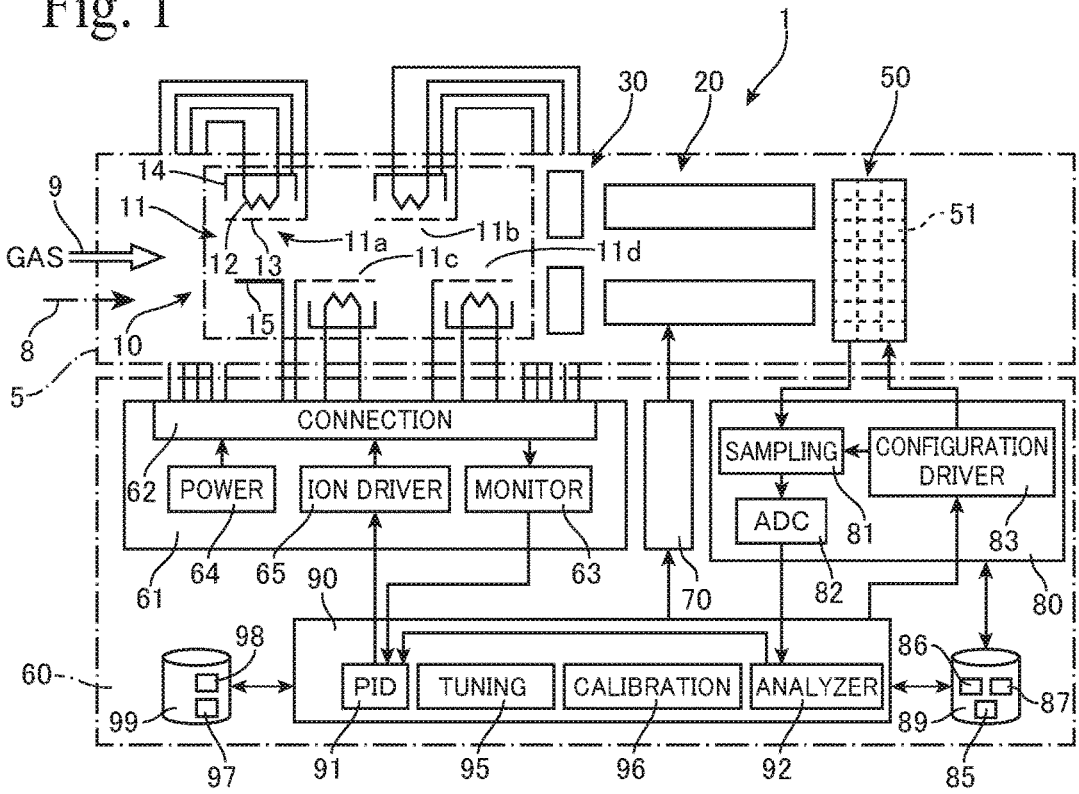
FIG. 1 is a diagram showing an overview of an analyzer.

FIG. 1 shows one example of a gas analyzer. This analyzer (analyzer apparatus, analytical device) 1 is a quadrupole mass spectrometry apparatus (an analyzer of quadrupole mass spectrometry type) and includes an ionizer unit 10 that ionizes a sampled gas 9, a quadrupole filter unit 20 that selectively passes ionized molecules (i.e., ions), a focusing unit (ion attracting electrode) 30 that guides ions from the ionizer unit 10 to the filter unit 20, a detection unit (detector unit) 50 that detects ions that have been filtered by the filter unit 20, and a control unit 60. The analyzer 1 includes a vacuum chamber 5, with the ionizer unit 10, the filter unit 20, the focusing unit 30, and the detection unit 50 being housed inside the vacuum chamber 5.

The ionizer unit 10 includes four ion sources 11*a* to 11*d*. The respective ion sources 11*a* to 11*d* include a filament 12 that emits thermal electrons, a grid (grid electrode) 13, and a repeller (repeller electrode) 14. The ionizer unit 10 includes a collector (collector electrode) 15 that also measures the total pressure. Each filament 12 is supplied with a filament voltage Vf that is positively or negatively biased with respect to the chamber 5, and outputs thermal electrons by being supplied with the filament current If. A grid voltage Vg that produces a positive potential difference (bias) Ve with respect to the filament voltage Vf is supplied to each grid 13, and accelerates the thermal electrons so as to reach a predetermined ionization energy. An equal voltage to the filament voltage Vf is supplied to each repeller 14 so that the thermal electrons are concentrated in the direction of the grid. The emitter that emits the thermal electrons may be the filament 12 or may be a disk cathode.

The control unit 60 is configured using resources such as a circuit board, a CPU, and a memory. The control unit 60 includes an ionizer apparatus control unit (ionizer control unit) 61 that controls the ion sources 11*a* to 11*d*, a filter control unit 70 that controls the focusing unit 30 and the quadrupole filter unit 20, a detector control unit 80 that controls the detection unit 50, and a central control unit 90 that carries out cooperative control of such control units.

The central control unit (system controller) 90 includes a PID unit 91 that carries out feedback control over the ionizer unit 10 via the ionizer control unit 61, an analyzer unit 92 that controls the detection unit 50 via the detector control unit 80 and evaluates the ion current obtained by the detection unit 50, a tuning unit (automatic tuning unit) 95 that automatically adjusts the measurement conditions of the analyzer apparatus 1 using a tuning gas (calibration gas) 8, and a calibration unit 96 that mainly carries out adjustment of the magnetic field of the filter 20.

As described below, the ionizer control unit 61 includes a function for reconfiguring the ionizer unit 10 and the detector control unit 80 includes a function for reconfiguring the detection unit 50. Accordingly, the analyzer apparatus 1 includes the programmable ionizer unit 10 and the programmable detection unit 50, optimizes the ionizer unit 10 in accordance with the gas 9 that is the measurement target, the usage state, and the like, and optimizes the detection unit 50 in accordance with the optimization of the ionizer unit 10 to analyze components (molecules, chemical substances, compounds) included in the gas 9. The analyzing result of the detection unit 50, that is, the output of the analyzer unit 92 can be used to monitor the ionizer unit 10, which makes it possible to further optimize the ionizer unit 10. In this way, the control unit 60 includes a function that carries out closed-loop control of the ionizer unit 10 and the detection unit 50.

The ionizer control unit 61 includes a connection circuit 62 that switches between the plurality of ion sources 11, or more specifically, electrical connections between the ion sources 11*a* to 11*d*, a monitor 63 that measures or estimates, via the connection circuit 62, variations in characteristic values, for example, variations in resistance values and variations in power consumption, of the respective ion sources 11*a* to 11*d*, a power supplying unit 64 that supplies power to the ion sources 11*a* to 11*d* via the connection circuit 62, and a driving control unit (ion driving unit) 65 that controls the selecting or connecting of the ion sources 11*a* to 11*d* based on the measurement results of the monitor 63. The driving control unit 65 includes a function as a reconfiguration unit (second reconfiguration unit) that switches between the configurations of the ionizer unit 10 to realize a programmable ionizer unit 10.

The driving control unit 65 includes a function that reconfigures the connections of the ion sources 11*a* to 11*d* and, based on variations in the characteristics of the ion sources 11*a* to 11*d*, selects one of the ion sources 11*a* to 11*d* and makes the selected ion source active by supplying power, connects and uses (i.e., activates) a number of ion sources in parallel, connects and uses a number of ion sources in series, or connects and uses a number of ion sources in series and in parallel. The driving control unit 65 further includes a function of controlling the supplying powers to the ion sources 11*a* to 11*d* that have been activated to control (reconfigure) the temperatures of the emitters (filaments) 12.

Figure 2:
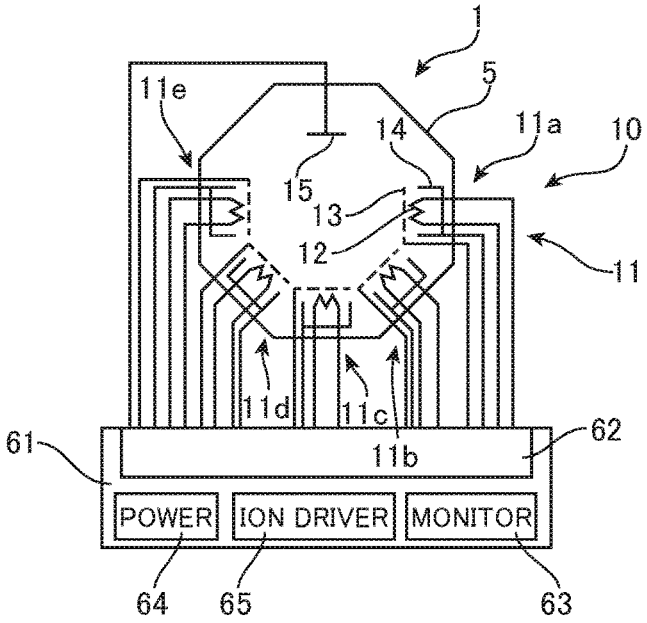
FIG. 2 is a diagram showing an overview of a different analyzer.

FIG. 2 shows a different example of the ionizer unit 10. In the ionizer unit 10, five ion sources 11*a* to 11*e* are disposed in the housing (vacuum chamber) 5 that has an octagonal cross section, and the connections and temperatures are controlled (reconfigured) by the ionizer control unit 61. Accordingly, the ionizer unit 10 is also programmable, and it is possible to use the five ion sources 11*a* to 11*e* individually or in combination.

Figure 3:
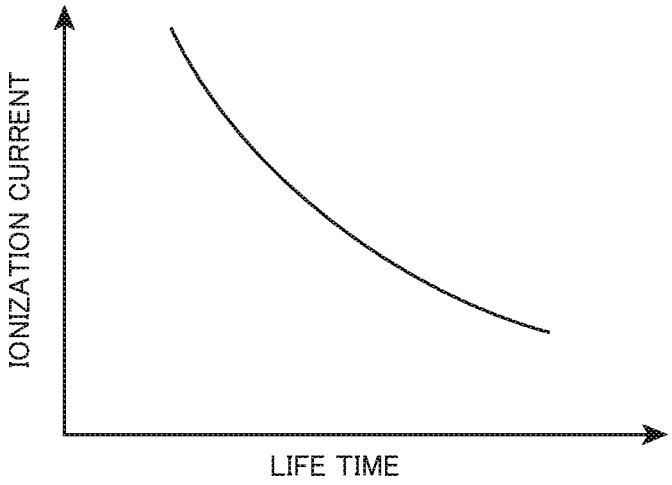
FIG. 3 shows an aging variation in an ion source.

FIG. 3 shows typical characteristics of an ion source. In the ion sources 11, the resistance of the filament 12 increases and the ionization current decreases as usage time (life time) increases. Accordingly, it is necessary to increase the filament voltage Vf in order to achieve a predetermined ionization current. In order to change the bias voltage with respect to the housing 5 and/or to achieve a predetermined ionization voltage Ve, it is necessary to change the grid voltage Vg in accordance with the variation in the filament voltage Vf, and in accordance with this, it is necessary to further change the conditions of the focusing unit 30, which may affects the setting conditions of the filter unit 20. Accordingly, the range where it is possible to control the voltage of individual ion sources and keep the ionization current constant is limited. On the other hand, if the ionization current is not kept constant, the total pressure will change and the sensitivity of the detection unit 50 will also vary.

There are cases where the ionization voltage Ve is limited to produce insensitivity to the components of the carrier gas, in such cases it could be difficult to control the ionization voltage Ve in order to maintain the ionization current. For example, the ionization energy of helium is 24.58 eV, and in cases where helium is used as a carrier gas, it is desirable to limit the ionization voltage to 24V or below. Also, during mass spectrometry, the ionization energy at which a lot of data is obtained is 70 eV, so that the ionization voltage is often controlled to 70V. In addition, in mobile applications, there is a limit on the power supply voltage and a limit on the consumed current, so that it is desirable in some cases to limit the ionization voltage. Accordingly, it is important to keep the ionization current within a predetermined range in response to aging (changes over time) and the like, while keeping the ionization voltage constant.

The driving control unit 65 of the ionizer control unit 61 includes a function for monitoring the current characteristics and the usage time of the ion sources 11 and automatically switching to a different ion source when the current characteristics (resistance) of the filament 12 that is the emitter of an ion source 11 have deteriorated beyond a predetermined range due to operating conditions such as the usage time and operating temperature, or when such deterioration is expected.

The driving control unit 65 further includes a function that controls, when it has been determined that the current characteristics of all of the ion sources 11 have fallen below a predetermined range, or the respective resistances have exceeded (or become equal to or higher than) a predetermined value (threshold), the connections of the ion sources 11 to combine a plurality of the ion sources 11 so that the ionization current is within a predetermined range, while having the lowest possible effect on the internal characteristics of the ionizer unit 10. Typically, the filaments 12 of two or more ion sources are used having been connected in parallel. To adjust the voltage, it is also possible to connect and use the filaments 12 of a plurality of ion sources in series or to use filaments 12 that have been connected in series and in parallel.

Due to the driving control unit 65 reconfiguring the connections between the emitters 12 of the plurality of ion sources 11, even when sufficient performance is not obtained by the performance of the individual emitters 12 (even if the emitters having reached a limit due of their normal life span), it is possible to achieve sufficient performance as the ionizer unit 10 by connecting a plurality of emitters 12 in parallel to activate a plurality of the ion sources 11. By activating a plurality of ion sources 11 with sufficient performance, it is possible to maintain the ionization performance of the ionizer unit 10 at a high level and to set ionization conditions that are suited to measurement of trace components. Also, operating the ionizer unit 10 in a state where the filament current has been intentionally reduced by activating a plurality of ion sources 11 and increasing the life spans of the ion sources 11.

The driving control unit 65 further includes a function for applying specific voltages separately to the filaments 12 and the grids 13 of the ion sources 11*a* to 11*d*. As one example, by applying the same voltage as the repeller 14 to the grids 13 of non-operating ion sources 11, dirtying of the filaments 12 of non-operating ion sources 11 by gas components is suppressed. It is also possible, by applying the same potential as the grids 13 of the operating ion sources 11, or a similar potential, to the grids 13 of the non-operating ion sources 11, to control the distribution of thermal electrons inside the ionizer unit 10.

Figure 4:
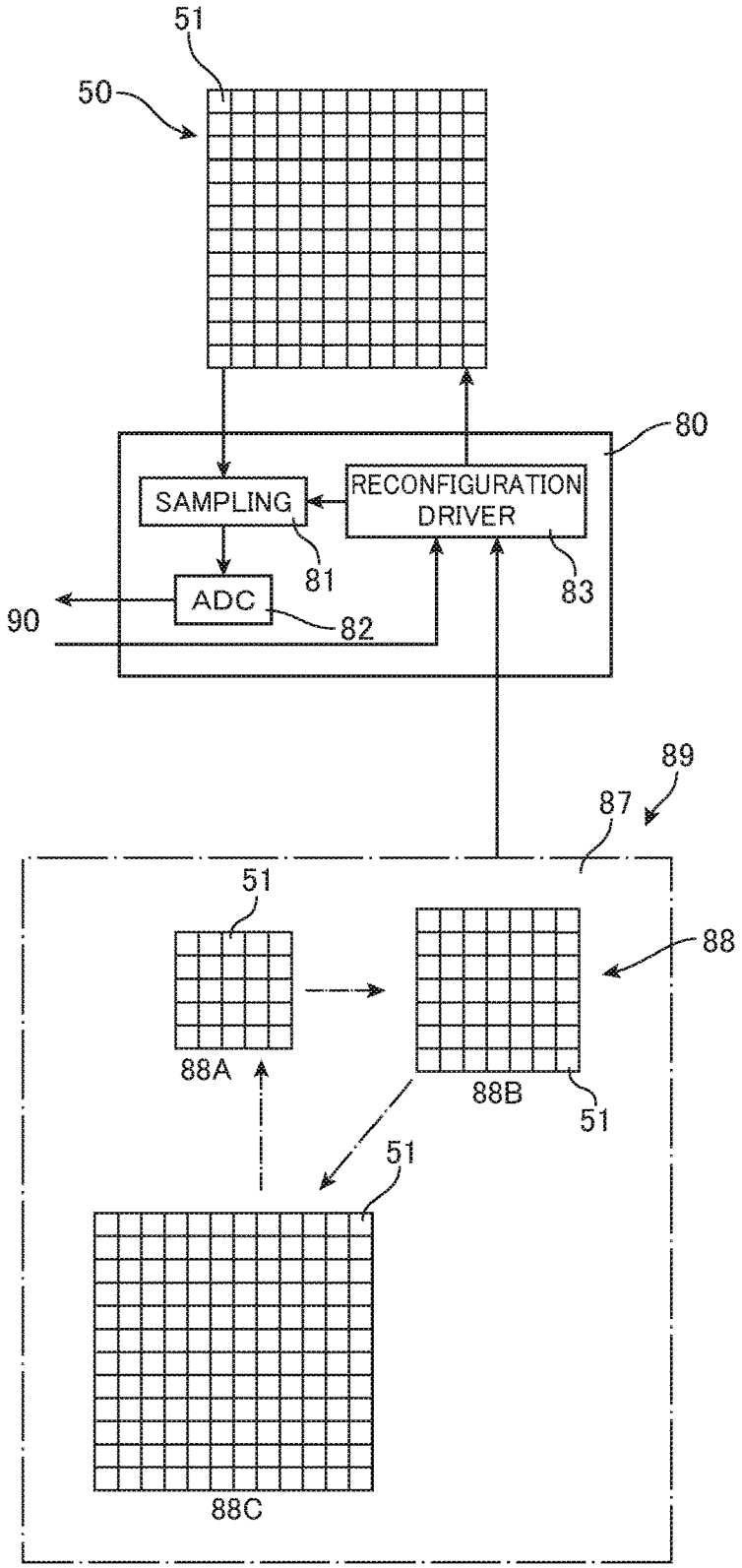
FIG. 4 shows reconfiguring a detection unit.

FIG. 4 shows the detection unit (detector unit) 50 and the detector control unit 80 that have been extracted. The detector control unit 80 adjusts the sensitivity of the detection unit 50 by reconfiguring the detection pattern of the detection unit 50. The detection unit 50 includes a plurality of ion collector elements (detection elements, detector element) 51 that detect ions in the form of ion currents that flow due to contact with ions that have passed the filter unit 20. A typical example of an ion collector element is a Faraday cup. The elements 51 may also be secondary electron multiplier tubes (electron multipliers), CCDs, or the like In the detection unit 50, 144 elements 51 are laid out in two dimensions to form a matrix with 12 vertical elements and 12 horizontal elements. The layout of the elements 51 may be a matrix with equal numbers of horizontal and vertical elements or may be a matrix with different numbers of horizontal and vertical elements, may be a layout on a two-dimensional plane, or may be a layout on a three-dimensional plane so that the elements are equidistant from the end of the filter 20. The number of elements 51 that construct the detection unit 50 is not limited to 144 and may be a larger number or a smaller number.

The detector control unit 80 includes a reconfiguration unit (first reconfiguration unit, configuration driver) 83 that activates the detection elements 51 that are to be enabled (used) for detection out of (among) the plurality of detection elements 51. The reconfiguration unit 83 selects one of a plurality of detection patterns 88, for example patterns 88A, 88B, and 88C stored in a configuration buffer 87 included in a tuning database 89 to switch or change the pattern 88 including the elements 51 to be enabled or activated in the detection unit 50. Accordingly, the reconfiguration unit 83 provides a programmable detection unit 50 whose detection area (detection sensitivity) and spatial detection sensitivity in a two-dimensional or three-dimension space (detection positions) are variable.

The detector control unit 80 further includes a sampling unit 81 that regularly samples detection results (ion currents) of the elements 51 that have been activated in accordance with the pattern 88 and an analog-digital convertor (ADC) that digitizes the values of all of the elements that have been sampled. The sampling unit 81 may sample the detection results of all 144 elements 51, and then integrate the detection values of the elements 51 included in the pattern 88 selected by the reconfiguration driver 83 from all of the elements 51 and output as the detection result (ion current). The detection result that has been digitized by the ADC 82 is outputted to the analyzer 92 of the system controller 90. The detection result may be outputted wirelessly or via wires via the system controller 90, or directly from the ADC 82, to an external server or the like that collects data.

As one example, on acquiring information that the ionizer control unit 61 has switched to a new ion source 11, the reconfiguration unit 83 first selects the pattern 88A (5×5) with the smallest area, and when a predetermined time has passed, then selects the pattern 88B (7×7) with the next largest area, and when more time has passed, then selects the pattern 88C (12×12) with a yet larger area, with integrated values of the elements 51 included in such patterns being outputted as the detection results (ion currents). As the timing for switching the patterns 88, in place of time, or in addition to time, it is possible to make a determination based on the result of monitoring the characteristic values of the ion sources 11 and/or the values of the ion currents obtained for the respective patterns 88.

The reconfiguration unit 83 may also switch between the patterns 88 based on the result of automatic tuning carried out by the tuning unit 95. Such automatic tuning may be carried out as a result of regularly monitoring various parameters of the analyzer apparatus 1 or according to an external instruction or cause. Tuning is also carried out automatically when carrying out calibration.

In tuning, in place of the measurement gas 9, gas for calibration purposes (i.e., tuning gas) 8 whose components and concentration are confirmed is measured by the analyzer apparatus 1 at a predetermined interval, the characteristics of the ionizer unit 10 and the characteristics of the detection unit 50 are determined and the various parameters of the ionizer unit 10 are tuned. Tuning includes optimization of gas flow, optimization of the conditions of the filter unit 20 and the like, and may include reconfiguration of the ionizer unit 10 and the detection unit 50, respectively.

Figure 5:
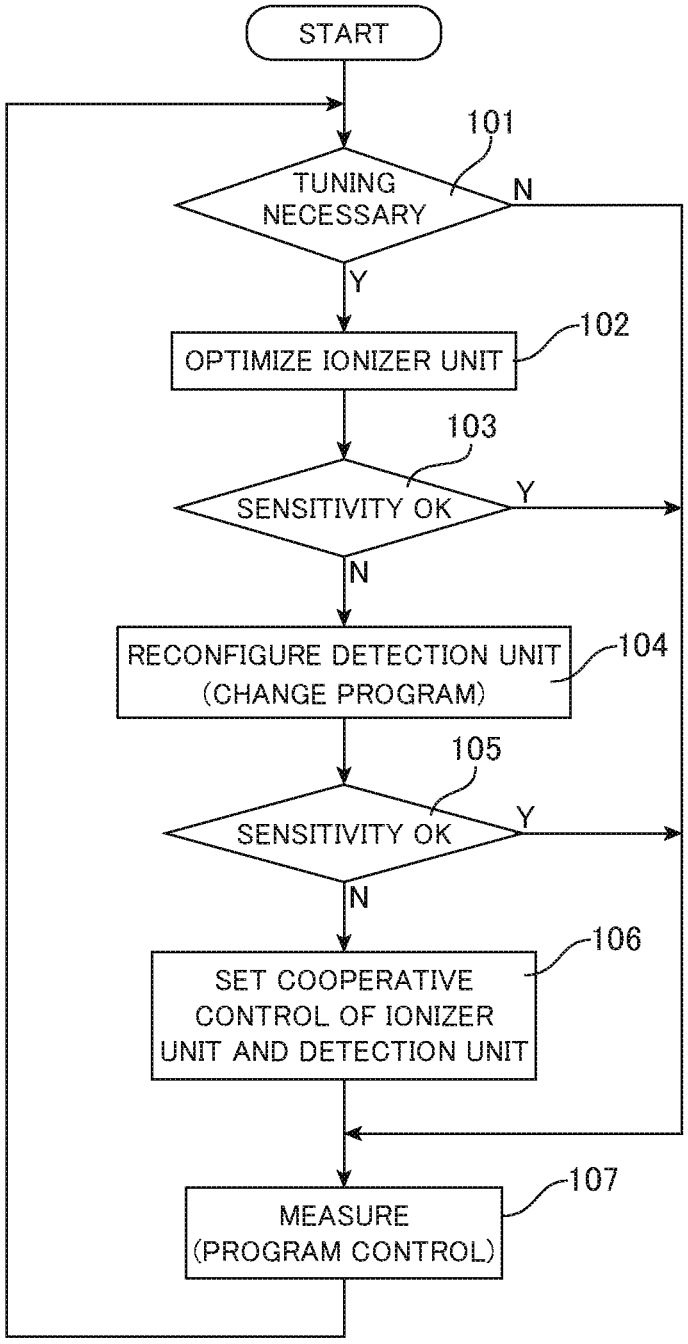
FIG. 5 is a flowchart showing processing for automatic tuning.

FIG. 5 shows an overview of an automatic tuning process by way of a flowchart. Note that although not illustrated in the flowchart, measurement of the tuning gas 8 is carried out from time to time during tuning. In step 101, once the timing at which automatic tuning is to be carried out has been judged, in step 102, the tuning unit 95 optimizes the configuration of the ionizer unit 10. Based on characteristics information of the ion sources 11 that has been accumulated and stocked in advance in the database 89, the tuning unit 95 is capable of predicting changes in characteristics, the remaining life time, and the like of the selected ion sources 11 from the operating time of such ion sources 11. The tuning unit 95 is also capable of obtaining changes in the characteristics of the ion sources 11 from the monitoring results of the monitor 63 during operation. The tuning unit 95 is also capable of verifying changes in the characteristics of the selected ion sources 11 from the measurement results of the tuning gas 8 whose components and concentration have been proved.

Based on changes in the characteristics of the ion sources 11, the tuning unit 95 changes the configuration of the ionizer unit 10, that is, such as the selection, connections, ionization currents and other operating conditions, and the like of the plurality of ion sources to an optimal configuration with targeting such as maintaining the ionization performance in a predetermined range and extending the lifetime of the ion sources 11 as much of possible. The tuning unit 95 reconfigures the ionizer unit 10 via the driving control unit 65 of the ionizer control unit 61.

In step 103, if the tuning unit 95 has determined that a desired sensitivity (measurement sensitivity) has been obtained by the optimized ionizer unit 10 or the measurement results for the tuning gas 8 are favorable, the tuning ends and measurement is restarted in step 107.

If it is determined in step 103 that a desired sensitivity has not been obtained, in step 104, the detection unit 50 is reconfigured and/or the program that reconfigures the detection unit 50 during measurement is changed. By changing the detection sensitivity of the detection unit 50, it is possible to obtain linear measurement results in a range that cannot be covered by reconfiguring the ionizer unit 10. As one example, in a case where it is possible to suppress variations in the ionization currents over the lifetimes of the ion sources 11 to a range of around ±20% by reconfiguring the ionizer unit 10, the tuning unit 95 reconfigures the detection unit 50 by selecting patterns 88 that compensate for variations in ionization intensity due to the changes in the ionization currents. By carrying optimization from time to time by tuning the ionizer unit 10 and the detection unit 50, as a whole it is possible to provide the analyzer apparatus 1 that outputs linear detection results over a long time. This means that it is possible to provide an analyzer apparatus (measurement apparatus) 1 that has a long life and high measurement sensitivity.

In step 104, when tuning the reconfiguration program of the detection unit 50, the tuning unit 95 sets the ionizer unit 10 using the driving control unit (ion driver) 65 so that ions (molecules, components) with a standard concentration included in the tuning gas 8 are detected using the detection pattern 88 with a medium-sized area set by the reconfiguration driver 83 of the detector control unit 80. In addition, the tuning unit 95 carries out programming of the reconfiguration driver 83 to be in conjunction with the conditions with which the filter unit 20 select ions so that a detection pattern 88 with a small area is selected when ions with a high concentration are selected and a detection pattern 88 with a large area is selected when ions with a low concentration are selected, and verifies whether it is possible with the detection patterns 88 of respectively different areas to detect the ions that are the detection target with an appropriate sensibility. The program 86 that reconfigures the detection patterns 88 can be stored in the tuning database 89.

The tuning gas 8 includes components that are expected to be typically included in the gas 9 that is the measurement target with the expected concentrations, and by programming detection patterns 88 for the respective components (ions) in advance using the tuning gas 8, it is possible to reduce how dependent the measurement sensitivity of the sample gas 9 is on concentration. That is, since it is possible with the programmable detection unit 50 to measure components with a high concentration with a relatively low sensitivity and to measure components with a low concentration with a relatively high sensitivity, it is possible to suppress fluctuations in the measurement precision between different components.

In step 105, if the tuning unit 95 has determined that it is possible to measure the various components of the tuning gas 8 with appropriate sensitivity or the measurement results for various components of the tuning gas 8 are favorable, the tuning ends and in step 107 the measurement is restarted using the program 86 obtained by the tuning.

When the conditions of the ionizer unit 10 are fixed, it might not be possible to sufficiently follow variations in concentrations of the respective components of the tuning gas 8 within the measurement range of the detection unit 50 ("turndown ratio") even if the detection unit is adjusted by switching between the detection patterns 88. On determining in step 105 that the sensitivity of the detection unit 50 cannot be sufficiently adjusted by programming the detection unit 50 itself, in step 106 the tuning unit 95 makes further settings for cooperative control where the ionizer unit 10 is reconfigured in cooperation with reconfiguration of the detection unit 50. On the cooperative control, the tuning unit 95 generates a program (ionizer/detector cooperative control program) 85 that carries out cooperative control over reconfiguration of the detection unit 50 and reconfiguration of the ionizer unit 10.

When in step 106, the cooperative control program 85 has been generated and confirmed and tuning has ended, in step 107 measurement using the program 85 obtained by the tuning is recommenced. With the cooperative control program 85, the reconfiguration unit (first reconfiguration unit) 83 of the detector control unit 80 selects or switches between the detection patterns 88 in keeping with the conditions with which the filter unit 20 selects ions, thereby dynamically reconfiguring the detection unit 50. Together with this, the driving control unit (second reconfiguration unit) 65 of the ionizer control unit 61 also controls the connections and/or driving currents of the ionizer unit 10 in accordance with the conditions with which the filter unit 20 selects ions, thereby dynamically reconfiguring the ionizer unit 10.

The series of processes for auto tuning can be provided as firmware incorporated in the memory 99 of the analyzer apparatus 1. The processes can also be provided as a program that runs on a host, for example, a personal computer, that controls the analyzer 1, and if the analyzer 1 is connected to a network, the processes can be provided as a program that controls the analyzer 1 via the network.

The tuning program 98 may be executed together with the calibration program 97 that includes adjustment of the magnetic field of the filter unit 20, may be executed periodically, and may be automatically executed when the temporal variation in the measurement results of the detection unit 50 exceed a predetermined range. When an appropriate operating time relating to the lifetime of the ion sources 11 has elapsed, the calibration program 97 may be performed for changing the ion current and the like to check for deterioration in performance and/or for simulating the performance of the analyzer 1.

Figure 6:
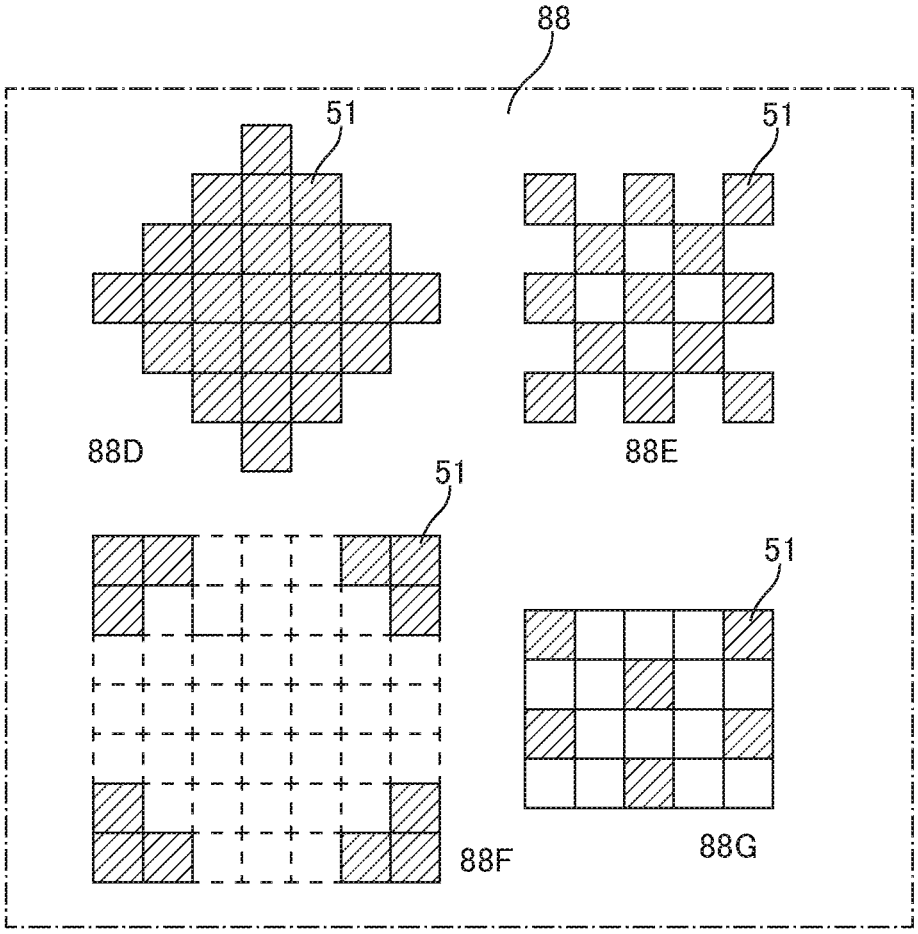
FIG. 6 shows other examples of detection patterns.

FIG. 6 shows a number of other examples of detection patterns that can be selected by the detection unit 50. In FIG. 6, the elements 51 that have been diagonally shaded are the activated elements 51. For a component with a low concentration, a pattern that is concentrated in the center like the pattern 88D may be desirable, there are cases where a mesh pattern like the pattern 88E may be desirable to average out the intensity. For a component for which the sensitivity is too high, precision may be improved with a pattern, like the pattern 88F, that integrates the results of regions with low sensitivity. There are also cases were a pattern that has been appropriately thinned out, like the pattern 88G, is effective. The detection patterns 88 that can be programmed in the detection unit 50 are not limited to such patterns.

The detection pattern 88 is not limited to correcting (compensating for) the tuning of the ionizer unit 10 and can also be used to tune the measurement results (i.e., the output of the detection unit 50). As one example, when, as the result of measuring specified molecules or atoms at the filter unit 20, the sensitivity is too high and the results will become saturated, it is possible to adjust the measurement values to within the measurement range by using a pattern with a smaller area. The opposite is also possible. The detection sensitivity of detection elements 51 such as Faraday cups may also deteriorate due to aging. Accordingly, by changing the positions of the elements 51 that are activated according to the usage time, it is possible to automatically change the area and maintain linearity for the sensitivity of the detection unit 50 over a long time.

Respective patterns 88 that are suited to measuring various components (ions) may be found in advance via simulations, experimentation, or the like by specifying combinations of the type of filter unit 20 (such as quadrupole, FAIMS, or Wien filter) and the ionized molecules and/or atoms (chemical substances). In a state where the sampling conditions, the conditions of the ionizer unit 10, and also the conditions of the filter unit 20 are fixed or stable, the pattern 88 may change randomly or according to a specified algorithm so as to automatically select a pattern that is appropriate for measurement with such conditions and chemical substances. It is also possible to use a pattern 88 that has been decided as suitable for measurement of the certain component (the chemical substance to be measured) included in the gas 9 that is the measurement target, as one element for specifying the chemical substances to be measured. Also, by comparing a standard pattern 88 that is suited to measurement of the calibration gas 8 whose components and concentration have been specified and a pattern 88 decided during measurement, it is possible to determine the characteristics of the analyzer apparatus 1 and to determine the state of variation due to aging.

The analyzer 1 that includes the programmable ionizer unit 10 and detection unit 50 is superior as an analyzer apparatus incorporated in a portable appliance. When the analyzer 1 is incorporated in an appliance driven by a battery, such as a wearable or mobile appliance, there are cases where the battery capacity depends on the usage environment, such as the charging state, so that the power and/or voltage that can be consumed by the incorporated analyzer 1 will vary and/or be limited. As one example, in cases where there is no variation in the components and concentration of the gas 9 measured by the installed analyzer 1, it is possible to reduce the power consumption during monitoring by selecting a pattern 88 with low sensibility and continuing measuring. During monitoring, when variation in the components and concentration of the gas 9 has been observed or is expected due to some cause or event, it is possible to temporarily select a pattern 88 that has high sensitivity and to reconfigure the analyzer 1 in a state where the power consumption increases but the measurement sensitivity is high.

In this way, it is possible to flexibly change the overall measurement sensitivity of the analyzer 1. As one example, by selecting a state with high sensitivity when hazardous materials are detected or there is the risk of hazardous materials being present, it is possible to determine whether danger is present at lower concentrations and with faster timing.

In the analyzer 1, separate to patterns 88 used in analysis at some timing, information on all of the elements 51 of the detection unit 50 can be stored continuously in the memory of the analyzer 1, a server that is connected by an appropriate communication means, or in the cloud. In the same way as an event recorder, it is possible to regularly judge what is going on by observing the measurement results of limited patterns 88 and, when some event has occurred, to carry out more detailed analysis by analyzing all data that has been stored in the cloud or the like.

The analyzer described in the above explanation is one example of the present invention, but the analyzer apparatus may be mobile terminal including an analysis function, an appliance that is a control appliance for controlling plant equipment or the like and includes an analysis function, or may be a transport means such as a vehicle including an analysis function. Also, although not specifically mentioned in the present specification, other details and features may be modified, changed, added to, or amended within a range covered by the gist of the present invention, with the resulting appliances also being included in the scope of the patent claims.

The invention claimed is:

1. An analyzer comprising:

an ionizer that is configured to ionize molecules to be analyzed;

a filter that is configured to selectively pass ions generated by the ionizer via a magnetic field;

a detector that is configured to detect ions that have passed the filter; and a processing device that is configured (a) to measure a tuning gas having components with respective concentrations and provided at one or more predetermined intervals during an operation and (b) to adjust, based on the measuring, (i) an ion current of the ionizer, (ii) the magnetic field associated with the filter, (iii) and a sensitivity of the detector to detect the components and the respective concentrations of the components of the provided tuning gas.

2. The analyzer according to claim 1, wherein the tuning gas includes the components with concentrations that are included in a gas to be measured by the analyzer.

3. The analyzer according to claim 1, wherein the detector includes a plurality of detection elements disposed in a matrix, and the processing device is configured to switch between detection patterns comprised of one or more detection elements, used for detection, from among the plurality of detection elements, wherein each of the detection patterns have different detection areas.

4. The analyzer according to claim 1, wherein the ionizer includes a plurality of ion sources, and the analyzer further comprises a monitor that is configured to estimate or measure changes in characteristics of the plurality of ion sources respectively, and wherein the processing device is further to reconfigure, based on the changes in characteristics, among the plurality of ion sources, at least one of: a selection of ion sources to be activated, connections of ion sources to be activated, and supplying of power to ion sources to be activated.

5. A method for controlling an analyzer that includes an ionizer that is configured to ionize molecules to be analyzed, a filter that is configured to selectively pass ions generated by the ionizer via a magnetic field; and a detector that is configured to detect ions that have passed the filter, the method comprising:

measuring a tuning gas having components with respective concentrations and provided at one or more predetermined intervals during an operation; and adjusting, based on the measuring, (i) an ion current of the ionizer, (ii) the magnetic field associated with the filter, and (iii) a sensitivity of the detector to detect the components and the respective concentrations of the components of the provided tuning gas.

6. The method according to claim 5, wherein the measuring includes measuring the tuning gas that includes the components with concentrations that are included in a gas to be measured by the analyzer.

7. A non-transitory computer readable medium for an analyzer that includes an ionizer that is configured to ionize molecules to be analyzed, a filter that is configured to selectively pass ions generated by the ionizer via a magnetic field; and a detector that is configured to detect ions that have passed the filter, wherein the program product comprises executable code that when executed by a processing device, causes the processing device to perform:

measuring a tuning gas having components with respective concentrations and provided at one or more predetermined intervals during an operation, and adjusting, based on the measuring, (i) an ion current of the ionizer, (ii) the magnetic field associated with the filter, and (iii) a sensitivity of the detector to detect the components and the respective concentrations of the components of the tuning gas.

8. The non-transitory computer readable medium according to claim 7, wherein the measuring includes measuring the tuning gas that includes the components with concentrations that are included in a gas to be measured by the analyzer.

* * * * *